US011773713B1

(12) United States Patent
Taylor

(10) Patent No.: US 11,773,713 B1
(45) Date of Patent: Oct. 3, 2023

(54) SYSTEM AND METHOD FOR MEASUREMENT-WHILE- DRILLING (MWD) TOOL REMOVAL FROM A PIPE

(71) Applicant: BLACK DIAMOND OILFIELD RENTALS LLC, Conroe, TX (US)

(72) Inventor: Collin Taylor, Conroe, TX (US)

(73) Assignee: BLACK DIAMOND OILFIELD RENTALS, LLC, Conroe, TX (US)

( * ) Notice: Subject to any disclaimer, the term of this patent is extended or adjusted under 35 U.S.C. 154(b) by 0 days.

(21) Appl. No.: 18/109,745

(22) Filed: Feb. 14, 2023

(51) Int. Cl.
*E21B 47/01* (2012.01)

(52) U.S. Cl.
CPC ..... *E21B 47/01* (2013.01)

(58) Field of Classification Search
CPC ..... E21B 47/01
See application file for complete search history.

(56) References Cited

U.S. PATENT DOCUMENTS 4,090,573 A 5/1978 Rankin
4,255,120 A * 3/1981 Straitz, III ..... E21B 41/0071 431/114
6,959,603 B2 11/2005 Knight et al.
7,416,028 B2 8/2008 Prendin et al.
10,150,658 B1 * 12/2018 Benson ..... B66D 1/60
10,883,322 B2 1/2021 Gray-Stephens et al.
10,933,453 B2 3/2021 Zink et al.
2007/0056722 A1 * 3/2007 Angman ..... E21B 17/025 166/50
2009/0256124 A1 10/2009 Plumettaz
2010/0090183 A1 4/2010 Leto et al.
2014/0084946 A1 * 3/2014 Clark ..... H02J 50/80 324/654
2019/0203575 A1 * 7/2019 Schlosser ..... E21B 23/08
2022/0364442 A1 * 11/2022 Petty ..... E21B 41/0085

FOREIGN PATENT DOCUMENTS

KR 101311208 9/2013

* cited by examiner

*Primary Examiner* — Caroline N Butcher
(74) *Attorney, Agent, or Firm* — Dickinson Wright PLLC

(57) ABSTRACT

A system for assisting in the removal of an MWD tool from a pipe is disclosed. The system comprises: a stand-off bracket, a winch assembly configured to be mounted to the stand-off bracket, and a coupling. The winch assembly comprises a winch, a power supply for supplying power to the winch, and a controller for operating the winch. The coupling comprises a collar interface, configured to be mounted to a collar that contains a measurement while drilling (MWD) tool, and a stand-off bracket interface, configured to receive an end of the stand-off bracket distal from the winch. A method for operating the system is also disclosed.

33 Claims, 9 Drawing Sheets

SYSTEM AND METHOD FOR MEASUREMENT-WHILE- DRILLING (MWD) TOOL REMOVAL FROM A PIPE

TECHNICAL FIELD

The present disclosure relates generally to MWD tools and, in particular, to a system and method for removing an MWD tool from a pipe.

BACKGROUND

As drilling has become more complex, with horizontal and directional drills increasing in numbers, well logging has also had to adapt and improve. Measurement-While-Drilling ("MWD") is a type of well logging that incorporates the measurement tools into the drill string and provides real-time information to help with steering the drill. Specifically, an MWD tool is used to provide downhole sensor and status information to surface in a near real-time mode while drilling. This information is used to make decisions about controlling and steering the well to optimize the drilling speed and trajectory based on numerous factors. The ability to obtain real time data from the MWD tool allows for a relatively more economical and more efficient drilling operation.

The MWD tool is typically housed within a pipe, referred to as a drill collar, in such a manner that it cannot be easily removed. In fact, removal of the MWD tool typically requires that significant effort and present methods to remove the MWD tool are complex, time-consuming, and sometimes dangerous. Accordingly, improvements in working with MWD tools continue to be of interest.

SUMMARY

Embodiments of a system for removing an MWD tool from a pipe are disclosed. In an embodiment, there is provided a system, comprising: a stand-off bracket, a winch assembly configured to be mounted to the stand-off bracket, and a coupling. The winch assembly comprises a winch, a power supply for supplying power to the winch, and a controller for operating the winch. The coupling comprises a collar interface, configured to be mounted to a collar that contains a measurement while drilling (MWD) tool, and a stand-off bracket interface, configured to receive an end of the stand-off bracket distal from the winch.

In an example, a stand-off length of the system may be greater than or equal to a distance from an opening of the collar to a predefined position on a centralizer of the MWD tool inside the collar. The predefined position may be defined on the MWD tool at or between a proximal end of the centralizer and a distal end of the centralizer.

In another example, a sum of the stand-off length of the system and a length of the coupling may be greater than or equal to a distance from an opening of the collar to a predefined position on a centralizer of the MWD tool inside the collar. The predefined position may be defined on the MWD tool at or between a proximal end of the centralizer and a distal end of the centralizer.

In an example, the winch may comprise a J-hook configured to couple to the MWD tool inside the collar. The stand-off bracket may comprise a rigid tray with a rectangular sectional profile including a base and side walls that are complementary in shape to and can mate with the stand-off bracket interface. The stand-off bracket interface may be a slot in the coupling.

In an example, the collar interface may comprise a frustoconical protrusion from the coupling. The frustoconical protrusion may be externally threaded and configured to engage a thread in the collar. The coupling may have an aperture through which the MWD tool is removed from the collar.

In an example, a handle may be removably mounted to the coupling and configured to assist with attaching and removing the coupling relative to the collar. The handle may perpendicular to a longitudinal axis of the coupling.

In an example, the power supply may be a battery or a converter configured to electrically couple the winch to a third party power source. The third party power source may be an external battery or an AC mains supply.

In an example, a plurality of crossover subs are provided. Each of the crossover subs comprise a threaded opening configured to receive the collar interface of the coupling and a threaded protrusion configured to engage the collar. Different ones of the crossover subs have differently configured threaded protrusions for engaging with different collars.

In another embodiment, there is provided a method of removing an MWD tool from an interior of a collar. The method comprises mounting a tool removal system to the collar, coupling the tool removal system directly to the MWD tool, extracting at least a portion of the MWD tool from the collar, and then removing the tool removal system from the collar and completely removing the MWD tool from the collar manually.

In an example, mounting the tool removal system may comprise threading a coupling of the tool removal system into the collar and inserting a stand-off bracket of the tool removal system into a slot in the coupling. The coupling of the tool removal system may be threaded into the collar directly or via a crossover sub. Coupling the tool removal system may comprises coupling a winch, in particular a J-hook of the winch, to the MWD tool. In an example, removing the tool removal system may comprise removing the stand-off bracket from the coupling. Removing the tool removal system may further comprise unthreading the coupling from the collar. Unthreading the coupling from the collar may further comprise unthreading a crossover sub from the coupling or the collar.

In an example, the MWD tool may be pulled out of the collar only until a first centralizer of the MWD tool is visible from an exterior of the collar. In another example, the MWD tool may be pulled out of the collar only until a first centralizer of the MWD tool is outside of the collar. Extracting the portion of the MWD tool may be done with the winch.

In an example, the MWD may comprise a total of three centralizers but only one of the centralizers is removed by the tool removal system. The MWD tool may also comprise a battery, electronics, a pulser and a muleshoe. The MWD tool may be concentric within the collar.

In an example, a forklift is not required to remove the MWD tool from the collar.

BRIEF DESCRIPTION OF THE DRAWINGS

So that the manner in which the features and advantages of the embodiments are attained and can be understood in more detail, a more particular description can be had by reference to the embodiments that are illustrated in the appended drawings. However, the drawings illustrate only some embodiments and are not to be considered limiting in scope since there can be other equally effective embodiments.

It shall be noted that some of the details and/or features shown in the drawings herein may not be drawn to scale for clarity purposes.

The use of the same reference symbols in different drawings indicates similar or identical items.

DETAILED DESCRIPTION

The following discussion is directed to various embodiments of the present disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to imply that the scope of the disclosure, including the claims, is limited to that embodiment. Accordingly, various modifications and additions can be made to the exemplary embodiments discussed without departing from the scope of the present disclosure. For example, while the embodiments described below refer to particular features, the scope of this disclosure also includes embodiments having different combinations of features and embodiments that may not include all of the below described features.

Figure 1:
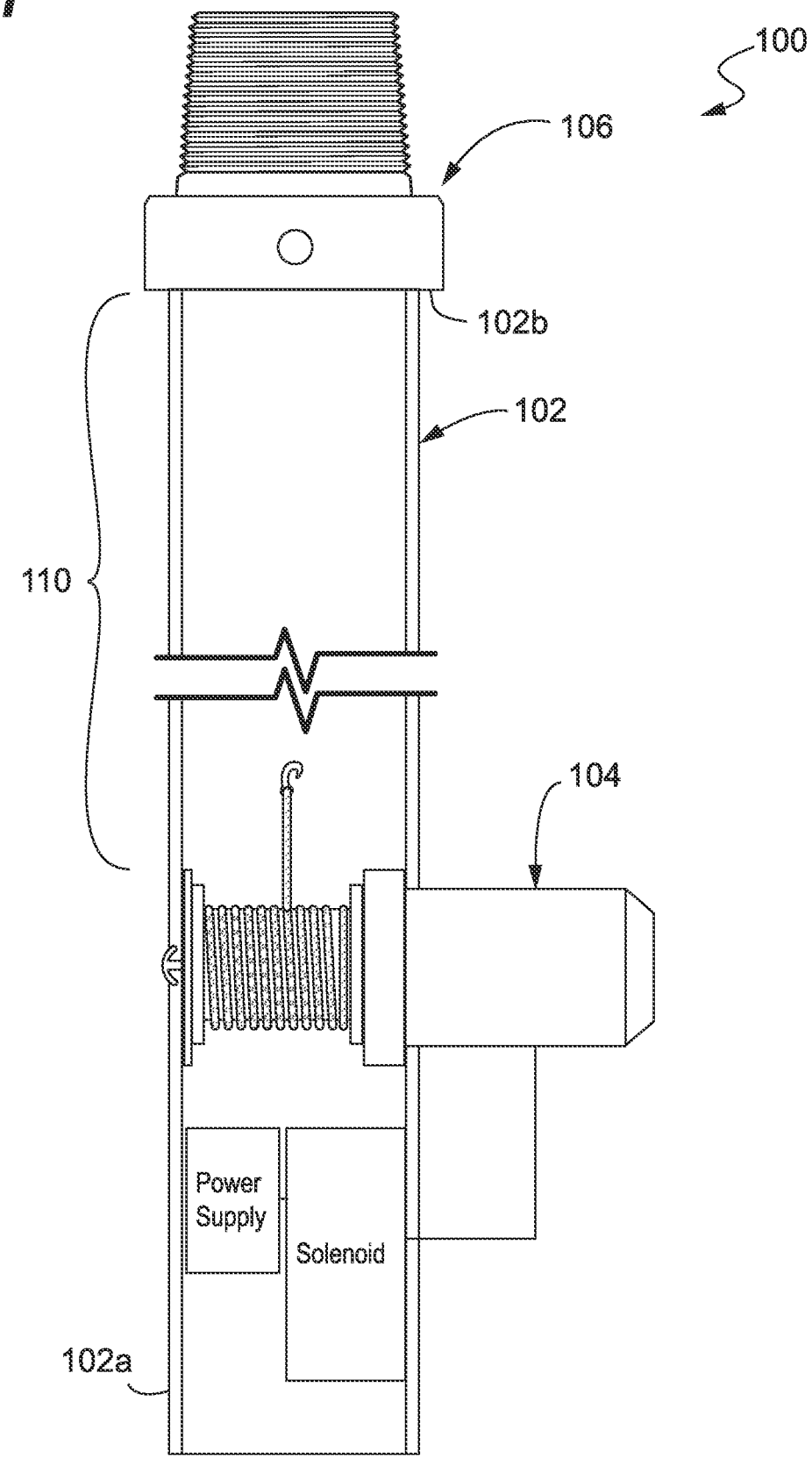
FIG. 1 illustrates an embodiment of a system in accordance with an embodiment of the invention.

Referring to FIG. 1, a tool removal system for removing a Measurement-While-Drilling (MWD) tool from a drill collar (or simply collar) is illustrated generally by numeral 100. The system comprises a stand-off bracket 102, a winch assembly 104, and a coupling 106. The winch assembly 104 is coupled to the stand-off bracket 102 proximal a first end 102*a* thereof. The coupling 106 is configured to be coupled to the stand-off bracket 102 at a second end 102*b* thereof. Accordingly, when assembled, the coupling 106 is located at a distal end of the stand-off bracket 102 from the winch assembly 104. The length of a portion of the stand-off bracket 102 positioned between the winch assembly 104 and the coupling 106 is referred to as the stand-off length 110.

Figure 2:
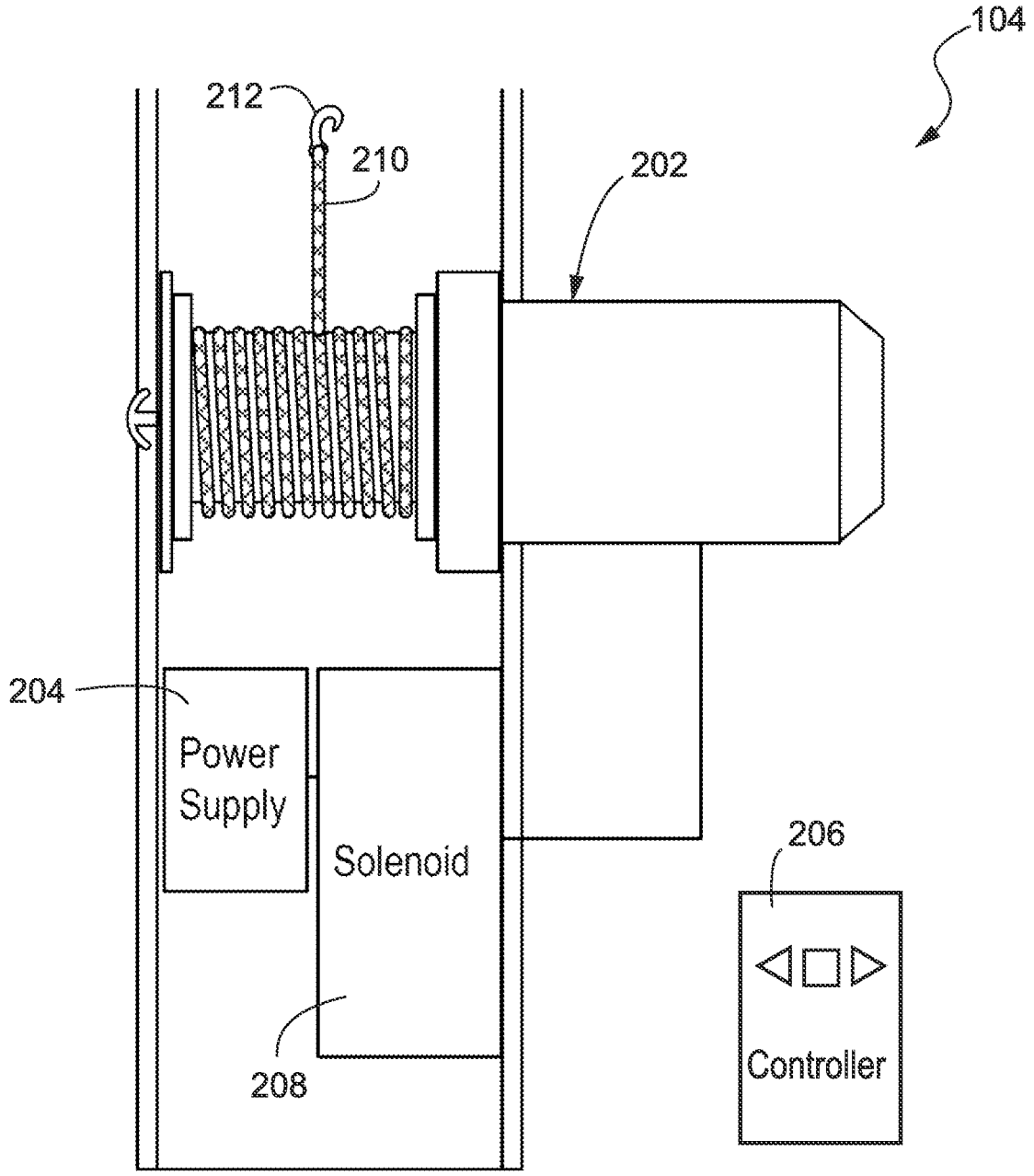
FIG. 2 illustrates an embodiment of a winch assembly.

Referring to FIG. 2, an enlarged view of the winch assembly 104 is illustrated. The winch assembly 104 includes a winch 202, power supply 204, and a controller 206. The power supply 204 is configured to supply power to the winch 202 in response to a signal from the controller 206. A solenoid 208 may be used to selectively couple the power supply 204 to the winch 202 in response to the controller 206. In an embodiment, the power supply 204 is a battery which allows the system 100 to be relatively portable. Alternatively, the power supply 204 may be a converter configured to electrically couple the winch 202 to a third party power source. The third party power source may be, for example, a battery on nearby equipment. Alternatively, the third party power source may be an AC mains supply. In such case, the converter is configured to convert the power from AC power to DC power in order to power the winch 202.

The winch 202 further includes a retractable cable 210 coupled to a hook 212. The hook 212 is configured to mate with the MWD tool within the collar. In an embodiment, the hook 212 is a J-hook.

The controller 206 controls operation of the winch 202. For example, the controller 206 can be used to start and stop the operation of the winch. The controller can 206 also be used to control the direction of the winch 202; that is whether the cable 210 is to be let out or retracted. The controller 206 can be wired directly to the winch assembly 104 or it can be wireless.

Figure 3:
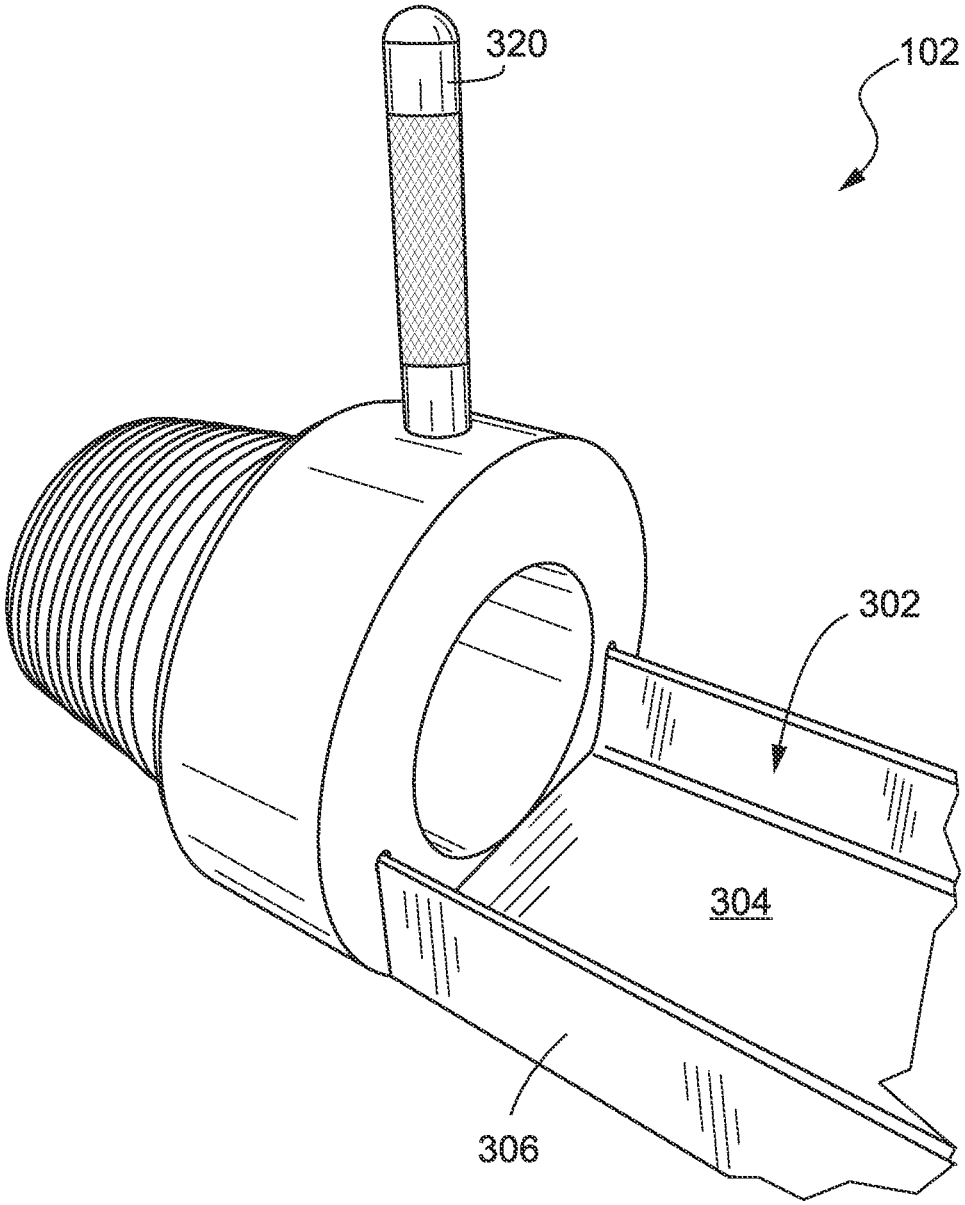
FIG. 3 illustrates an embodiment of a stand-off bracket mating with a coupling.

Referring to FIG. 3, the stand-off bracket 102 is illustrated in greater detail. The stand-off bracket 102 comprises a rigid tray 302. The rigid tray 302 has a generally rectangular sectional profile including a base 304 and side walls 306. In the illustrated embodiment, the angle between the exterior surface of the base 304 and the exterior surface of the side walls 306 is approximate 90 degrees. The angle between the internal surface of the base 304 and the internal surface of the side walls 306 is approximately 100 degrees. As will be appreciated by a person of ordinary skill in the art, various angles can be used.

Referring to FIGS. 4A to 4D, the coupling 106 is shown in greater detail. The coupling 106 includes a central portion 402 having a collar interface 404 and a stand-off bracket interface 406 on opposing sides thereof. The coupling 106 has an aperture 408, or central bore, through which the MWD tool can be removed from the collar.

The central portion 402 further includes threaded protrusion 420 to which a handle 320 (shown in FIG. 3) can be removably mounted. In an embodiment, the handle 320 is mounted perpendicular to a longitudinal axis of the coupling 106.

The collar interface 404 comprises a frustoconical protrusion 410. The outer surface 412 of the protrusion 410 is threaded and configured to engage an internally threaded surface of the collar.

The stand-off bracket interface 406 comprises a slot in the central portion 402. The slot 406 is shaped complementary to, and configured to receive, the second end 102*b* of the stand-off bracket 102.

Figure 4A:
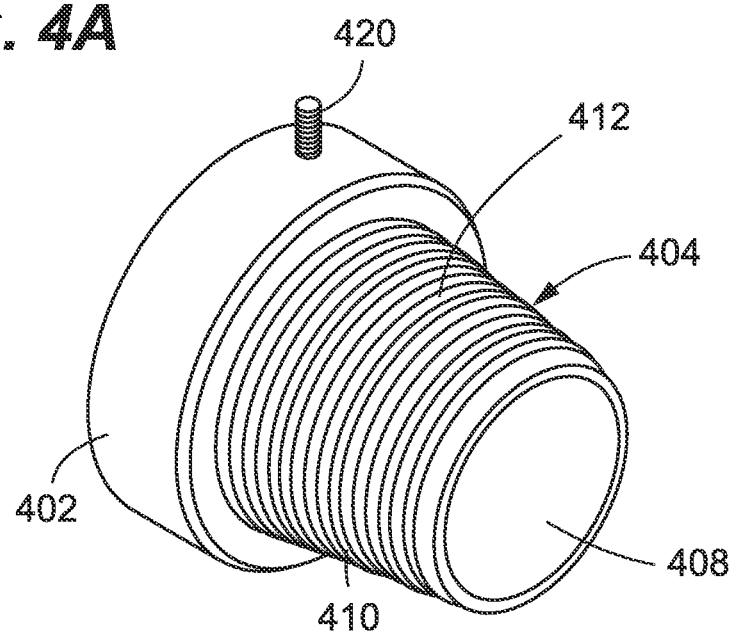
FIGS. 4A to 4D illustrate an embodiment of the coupling.
Figure 4B:
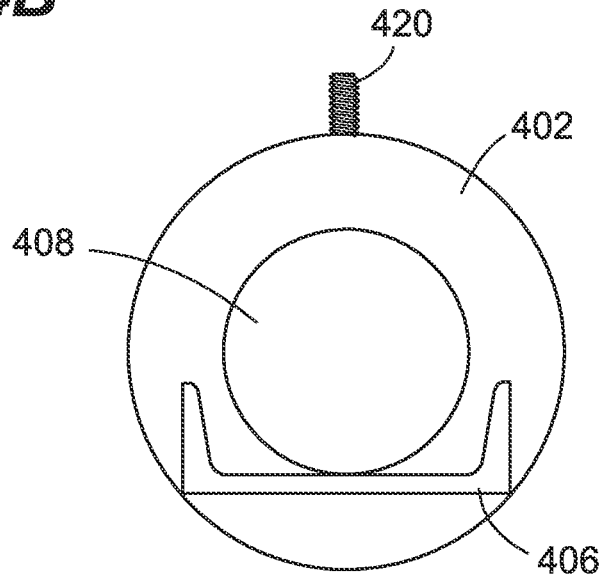
Figure 4C:
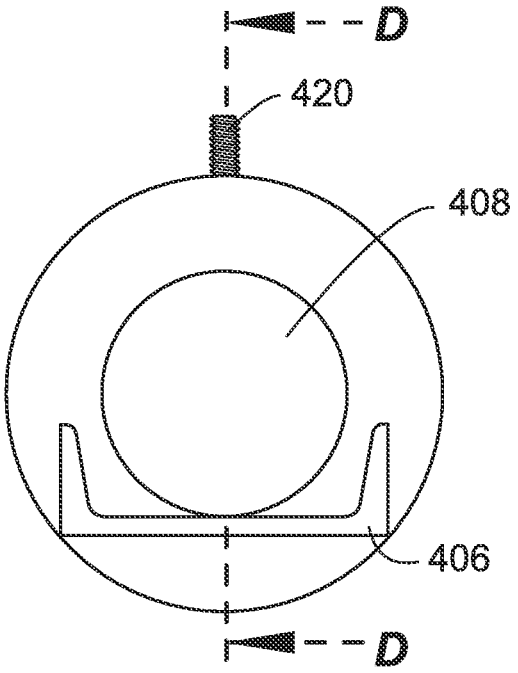
Figure 4D:
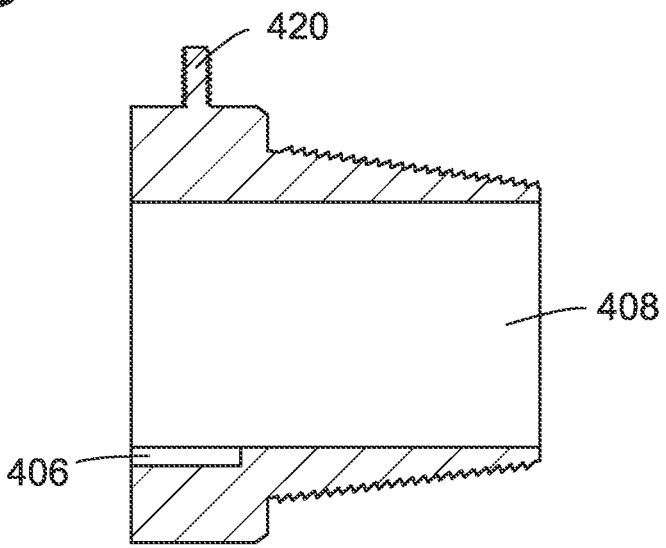
Figure 4E:
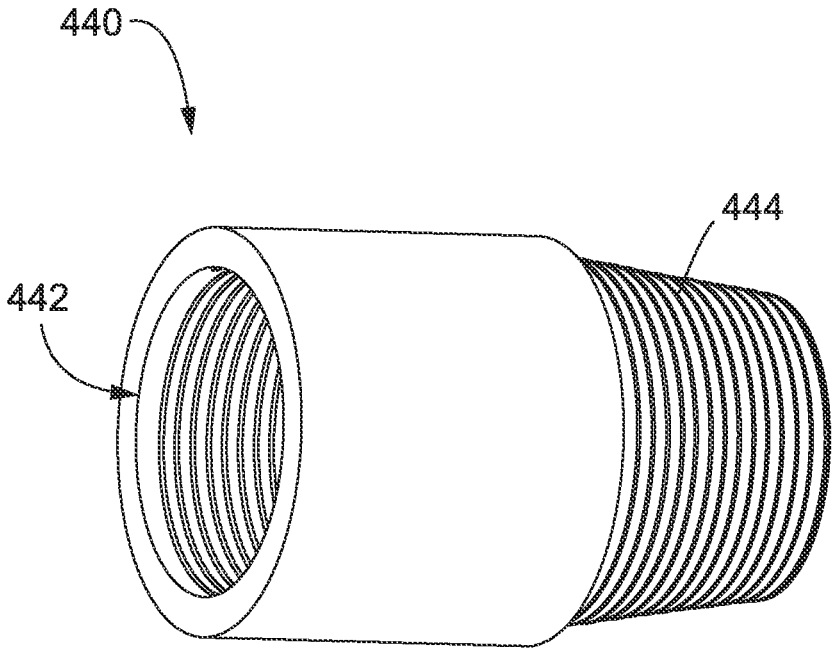
FIG. 4E illustrates an embodiment of a crossover sub for the coupling.

As will be appreciated, the collars may vary in sizing and thread characteristics. Accordingly, crossover subs can be used to couple the frustoconical protrusion 410 with different collars. Referring to FIG. 4E, a crossover sub is shown generally by numeral 440. The crossover sub 440 comprises a threaded opening 442 and a threaded protrusion 444. The threaded opening 442 is configured to receive the frustoconical protrusion 410 of the coupling 106. The threaded protrusion 444 is configured to engage the internally threaded surface of the collar. Different crossover subs 440 will have threaded protrusions 444, varying in size and thread characteristics, each configured to correspond with a different collar.

Figure 5A:
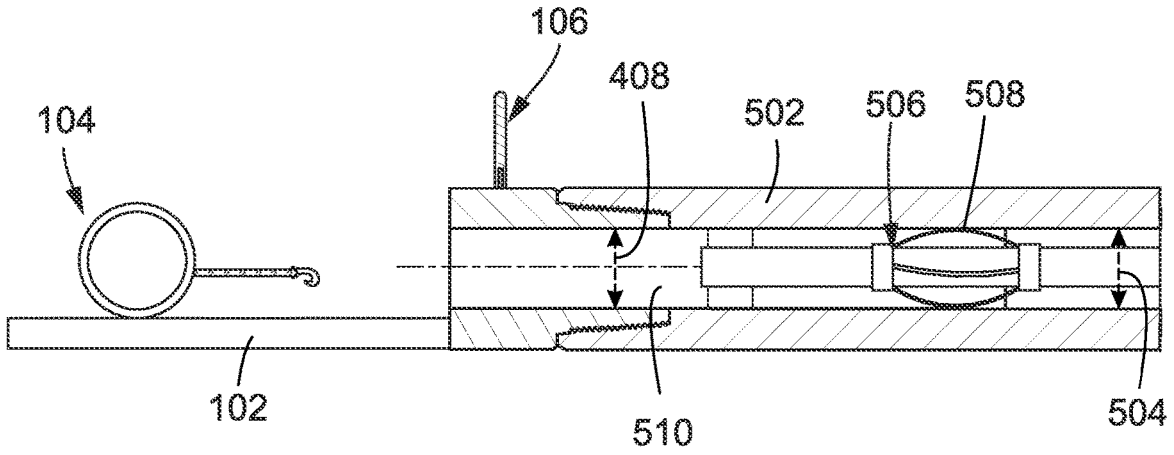
FIGS. 5A and 5B illustrate an embodiment of the system coupled to a collar.
Figure 5B:
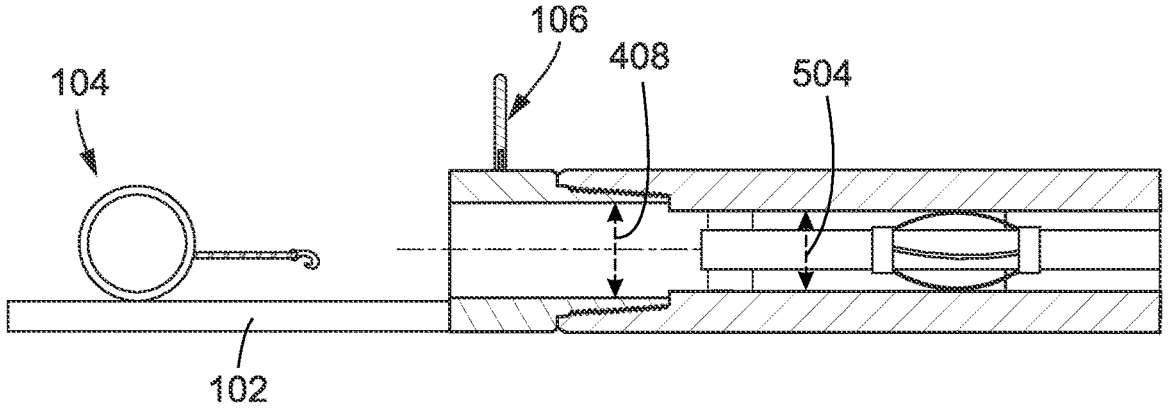

Referring to FIGS. 5A and 5B, a side view of the system 100 coupled to a collar is illustrated generally by numeral 500. The size of the coupling aperture 408 is as least as big as the size of the aperture 504 of the collar 502. The illustrated collar 502 includes an installed MWD tool 506. In the illustrated embodiment, the MWD tool 506 is concentric within the collar 502. The WMD tool 506 includes one or more spaced-apart centralizers 508. The MWD tool 506 may also include a battery, electronics, a pulser, and a muleshoe (not shown).

In an embodiment, the WMD tool includes three centralizers. Only one centralizer 508 is shown for ease of illustration. As shown, there is a tight fit between the centralizer 508 and the collar 502, which makes the MWD tool 506 difficult to remove. However, once the first centralizer 508 has been withdrawn from the collar 502, the MWD tool 506 becomes easier to remove and the winch assembly 104 is no longer required. In some embodiments, it may only be necessary to use the winch assembly 104 to withdraw the MWD tool 506 until the first centralizer 508 is visible at an opening 510 of the collar 502. In other embodiments, it may only be necessary to use the winch assembly 104 to withdraw the MWD tool 506 until the first centralizer is completely removed from the collar 502.

Accordingly, it is only necessary to provide enough distance in the system 100 to remove one centralizer 508. In the illustrated embodiment, the size of the coupling aperture 408 is the same size as the collar aperture 504. Thus, the winch assembly 104 needs to withdraw the centralizer 508 from both the collar 502 and the coupling 106. To facilitate this, the stand-off length is configured to be greater than or equal to a distance from the opening 510 of the collar 502 to a predefined position of the centralizer 508. The predefined position of the centralizer 508 may be a proximal end 512*a* of the centralizer 508 if the centralizer 508 needs to be withdrawn only until it is visible. The predefined position of the centralizer 508 may be a distal end 512*b* of the centralizer 508 if the centralizer 508 needs to be withdrawn completely. The predefined position of the centralizer 508 may be between the proximal end 512*a* and the distal end 512*b* of the centralizer 508.

In an alternative embodiment, illustrated in FIG. 5B, the size of the coupling aperture 408 is be greater than the size of the collar aperture 504. In such an embodiment, the winch assembly 104 only needs to withdraw the centralizer 508 from the collar itself 502. To facilitate this, the sum of the stand-off length and the length of the coupling 106 is configured to be greater than or equal to a distance from an opening 510 of collar 502 to the predefined position of the centralizer 508. This configuration allows for a shorter stand-off length to be implemented.

Various embodiments may be employed in which the size of the coupling aperture 408 varies with respect to the size of the collar aperture 504. For example, the coupling aperture 408 may gradually flare from the distal end of the coupling 106 towards the central portion 402 thereof. As another example, the coupling aperture 408 may be the same size as the collar aperture 504 in the collar interface 404 and larger than the collar aperture 504 in the central portion 402. These variations will result in different minimum stand-off length values.

Figure 6A:
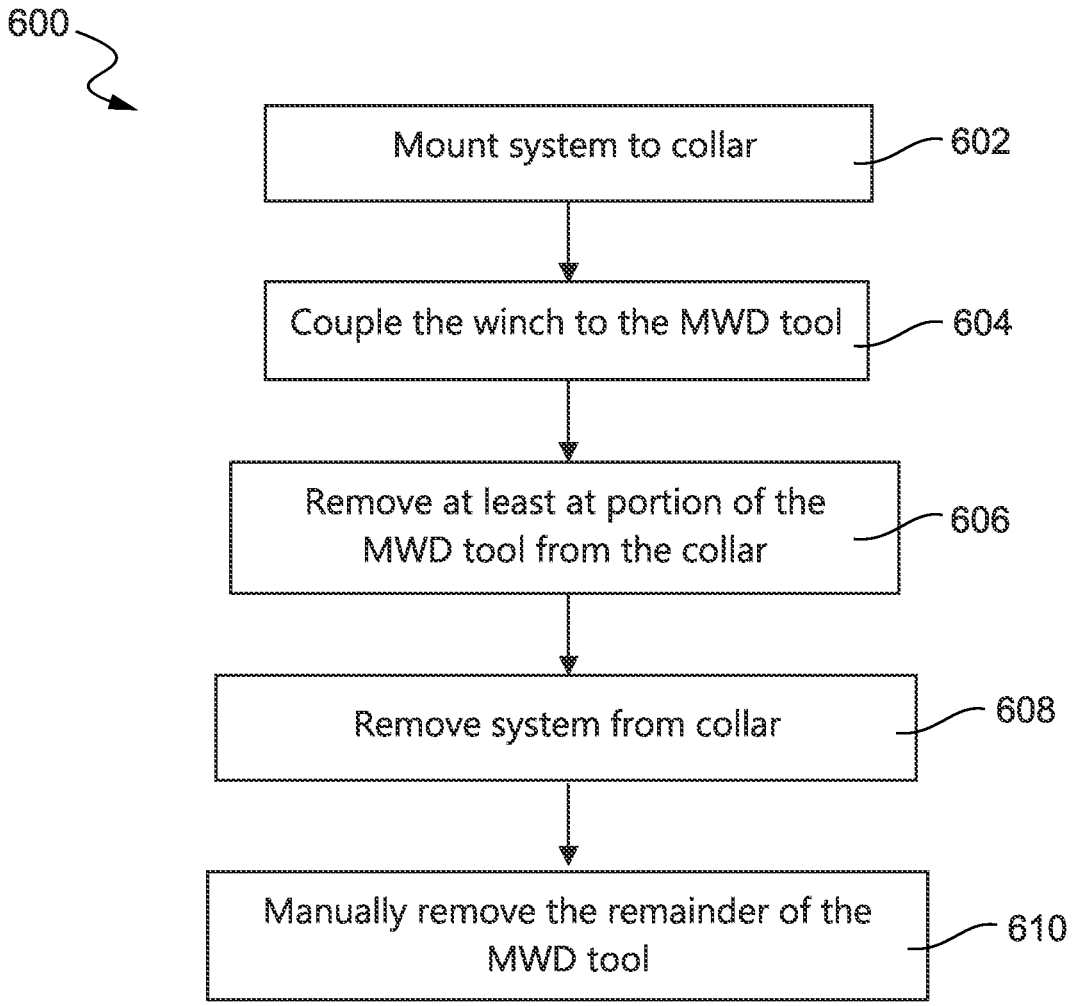
FIGS. 6A to 6C illustrate an embodiment of an operation of the system.
Figure 6B:
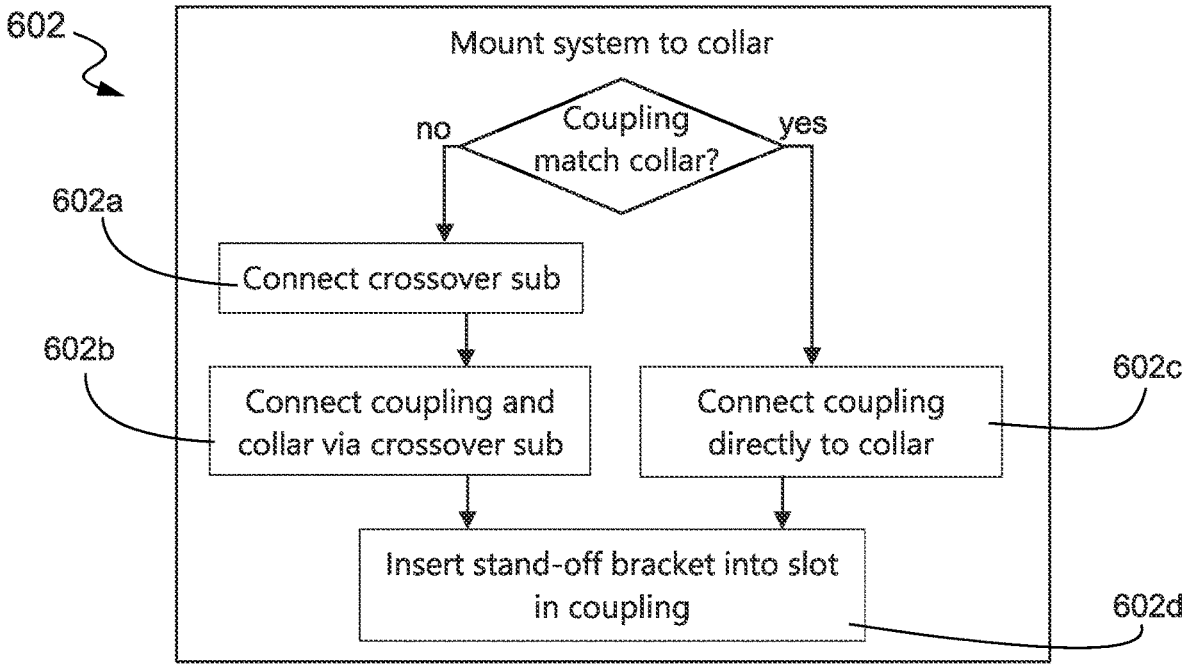
Figure 6C:
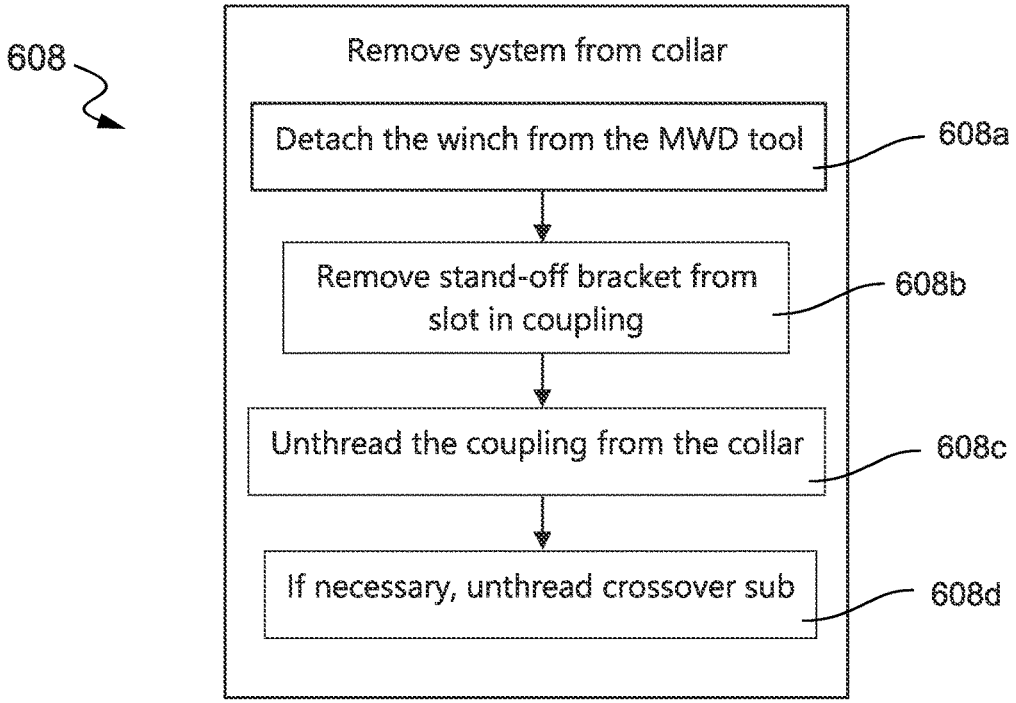

Referring to FIGS. 6A to 6C, a flow chart of the steps for removing the MWD tool 506 from the collar 502 is illustrated generally by numeral 600. In step 602, the system 100 is mounted to the collar 502. If the coupling 106 does not match the collar 502, then in step 602*a*, the crossover sub 440 that matches the collar 502 is coupled to either the coupling 106 or the collar 502. In step 602*b*, to mount the system 100 to the collar 502, the coupling 106 is threaded into the collar 502 via the crossover sub. If the coupling matches the collar 502, then in step 602*c*, to mount the system 100 to the collar 502, the coupling 106 is threaded directly into the collar 502. The handle 320 may be used to ensure that the coupling 106 and the collar 502 are tightly coupled. In step 602*d*, the stand-off bracket 102 is inserted into the slot 406 of the coupling 106.

In step 604, the winch 202 is coupled directly to the MWD tool 506. The controller 206 is used to direct the winch 202 to let out the cable 210 until the hook 212 can be coupled to the MWD tool 506. If desired, the winch 202 can be retracted so that the cable 210 is taut.

In step 606, at least a portion of the MWD tool 506 is removed from the collar 502. The controller 206 is used to direct the winch 202 to retract the cable 210 which, in turn, pulls the MWD tool 506 from the collar 502. As will be appreciated, while the MWD tool 506 is being withdrawn from the collar 502, the force from the winch 202 is transferred through the stand-off bracket 102 and the coupling 106, and is pushed against the collar 502. Thus, the force from the winch 202 removing the MWD 506 is offset by the force of the system 100 against the collar 502. This balance results in a "self-contained" pulling system. That is, the winch assembly 104 does not need to be bolted to the ground or to a truck to properly operate and the use of large equipment, such as forklifts, is not required.

In an embodiment, the winch 202 is used to pull the MWD tool 506 until the first centralizer 508 is visible at the opening of the collar 502. In an alternative embodiment, the winch 202 is used to pull the MWD tool 506 until the first centralizer 508 is visible at the opening of the coupling 106. In yet an alternative embodiment, the winch 202 is used to pull the MWD tool 506 until the first centralizer 508 has been withdrawn from the collar 502. In yet an alternative embodiment, the winch 202 is used to pull the MWD tool 506 until the first centralizer 508 is has been removed from both the collar 502 and the coupling 106 and placed into the rigid tray 302.

In step 608, the system 100 is removed from the collar 502. In step 608*a*, the winch 202 is disconnected from the MWD tool 506. If necessary, the controller 206 can be used to direct the winch 202 to let out the cable 210 until the hook 212 can be removed from the MWD tool 506. In step 608*b*, the stand-off bracket 102 is removed from the slot 406 of the coupling 106. In step 608*c*, the coupling 106 is unthreaded from the collar 502. If the crossover sub 440 was used, then in step 608*d*, the crossover sub 440 is unthreaded from either the collar 502 or the coupling 106. The handle 320 may be needed to assist with unthreading the coupling 106. In an alternative embodiment, the coupling 106 and/or the crossover sub 440 may not need to be removed.

In step 610, the remainder of the MWD tool 506 is removed from the collar 502 manually, without the use of the winch 202.

Other embodiments can include one or more of the following items.

1. A system comprising:
   a stand-off bracket;
   a winch assembly configured to be mounted to the stand-off bracket, the winch assembly comprising:
   a winch;
   a power supply for supplying power to the winch; and
   a controller for operating the winch; and
   a coupling comprising:
   a collar interface configured to be mounted to a collar that contains a measurement while drilling (MWD) tool; and
   a stand-off bracket interface configured to couple to the stand-off bracket distal from the winch.
2. The system wherein a stand-off length of the system is greater than or equal to a distance from an opening of the collar to a predefined position on a centralizer of the MWD tool inside the collar.

3. The system wherein the predefined position is defined on the MWD tool at or between a proximal end of the centralizer and a distal end of the centralizer.
4. The system wherein a sum of the stand-off length of the system and a length of the coupling is greater than or equal to a distance from an opening of the collar to a predefined position on a centralizer of the MWD tool inside the collar.
5. The system wherein the predefined position is defined on the MWD tool at or between a proximal end of the centralizer and a distal end of the centralizer.
6. The system wherein the winch comprises a J-hook configured to couple to the MWD tool inside the collar.
7. The system wherein the stand-off bracket interface is a slot in the coupling.
8. The system wherein the stand-off bracket comprises a rigid tray with a rectangular sectional profile including a base and side walls that are complementary in shape to and can mate with the stand-off bracket interface.
9. The system wherein the collar interface comprises a frustoconical protrusion from the coupling.
10. The system wherein the frustoconical protrusion is threaded and configured to engage a thread in the collar.
11. The system further comprising a handle removably mounted to the coupling and configured to assist with attaching and removing the coupling relative to the collar.
12. The system wherein the coupling has an aperture through which the MWD tool is removed from the collar.
13. The system wherein the power supply is a battery or a converter configured to electrically couple the winch to a third party power source.
14. The system wherein the third party power source is an external battery or an AC mains supply.
15. The system wherein the collar interface and the stand-off bracket interface are on opposing sides of the coupling.
16. The system further comprising a plurality of crossover subs, each of the crossover subs comprising: a threaded opening configured to receive the collar interface of the coupling; and a threaded protrusion configured to engage the collar; wherein different ones of the crossover subs have differently configured threaded protrusions for engaging with different collars.
17. A method of removing an MWD tool from an interior of a collar, the method comprising:
(a) mounting a tool removal system to the collar;
(b) coupling the tool removal system directly to the MWD tool;
(c) extracting at least a portion of the MWD tool from the collar; and then
(d) removing the tool removal system from the collar; and
(e) completely removing the MWD tool from the collar manually.
18. The method wherein step (c) comprises pulling the MWD tool out of the collar only until a first centralizer of the MWD tool is visible from an exterior of the collar.
19. The method wherein step (c) comprises pulling the MWD tool out of the collar only until a first centralizer of the MWD tool is outside of the collar.
20. The method wherein the MWD comprises a total of three centralizers but only one of the centralizers is removed by the system.
21. The method wherein step (a) comprises threading a coupling of the tool removal system into the collar and inserting a stand-off bracket of the tool removal system into a slot in the coupling.
22. The method wherein step (b) comprises coupling a winch to the MWD tool and step (c) comprises extracting the portion of the MWD tool using the winch.
23. The method wherein step (d) comprises detaching the winch and removing the stand-off bracket from the coupling.
24. The method wherein step (d) further comprises unthreading the coupling from the collar.
25. The method wherein step (a) comprising threading the coupling of the tool removal system into the collar via a crossover sub.
26. The method wherein unthreading the coupling from the collar further comprises unthreading a crossover sub from the coupling or the collar.
27. The method wherein a forklift is not required to remove the MWD tool from the collar.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

What is claimed is:

1. A system comprising:

a stand-off bracket;

a winch assembly configured to be mounted to the stand-off bracket, the winch assembly comprising:

a winch;

a power supply for supplying power to the winch; and a controller for operating the winch; and a coupling comprising:

a collar interface configured to be mounted to a the collar that contains a measurement while drilling (MWD) tool; and a stand-off bracket interface configured to couple to the stand-off bracket distal from the winch;

wherein a stand-off length of the system is greater than or equal to a distance from an opening of the collar to a predefined position on a centralizer of the MWD tool inside the collar.

2. The system of claim 1, wherein the predefined position is defined on the MWD tool at or between a proximal end of the centralizer and a distal end of the centralizer.

3. The system of claim 1, wherein a sum of the stand-off length of the system and a length of the coupling is greater than or equal to a distance from an opening of the collar to the predefined position on the centralizer of the MWD tool inside the collar.

4. The system of claim 3 wherein the predefined position is defined on the MWD tool at or between a proximal end of the centralizer and a distal end of the centralizer.

5. The system of claim 1, wherein the winch comprises a J-hook configured to couple to the MWD tool inside the collar.

6. The system of claim 1, wherein the stand-off bracket interface is a slot in the coupling.

7. The system of claim 6, wherein the stand-off bracket comprises a rigid tray with a rectangular sectional profile including a base and side walls that are complementary in shape to and can mate with the stand-off bracket interface.

8. The system of claim 1, wherein the collar interface comprises a frustoconical protrusion from the coupling.

9. The system of claim 8, wherein the frustoconical protrusion is threaded and configured to engage a thread in the collar.

10. The system of claim 1, further comprising a handle removably mounted to the coupling and configured to assist with attaching and removing the coupling relative to the collar.

11. The system of claim 1, wherein the coupling has an aperture through which the MWD tool is removed from the collar.

12. The system of claim 1, wherein the power supply is a battery or a converter configured to electrically couple the winch to a third party power source.

13. The system of claim 12, wherein the third party power source is an external battery or an AC mains supply.

14. The system of claim 1, wherein the collar interface and the stand-off bracket interface are on opposing sides of the coupling.

15. The system of claim 1 further comprising a plurality of crossover subs, each of the crossover subs comprising: a threaded opening configured to receive the collar interface of the coupling; and a threaded protrusion configured to engage the collar; wherein different ones of the crossover subs have differently configured threaded protrusions for engaging with different collars.

16. A method of removing an MWD tool from an interior of a collar, the method comprising:

(a) mounting a tool removal system to the collar;

(b) coupling the tool removal system directly to the MWD tool;

(c) extracting a portion of the MWD tool from the collar using the tool removal system; and then (d) removing the tool removal system from the collar; and (e) completely removing the MWD tool from the collar manually.

17. The method of claim 16, wherein step (c) comprises pulling the MWD tool out of the collar only until a first centralizer of the MWD tool is visible from an exterior of the collar.

18. The method of claim 16, wherein step (c) comprises pulling the MWD tool out of the collar only until a first centralizer of the MWD tool is outside of the collar.

19. The method of claim 16, wherein the MWD comprises a total of three centralizers but only one of the centralizers is removed by the system.

20. The method of claim 16, wherein step (a) comprises threading a coupling of the tool removal system into the collar and inserting a stand-off bracket of the tool removal system into a slot in the coupling.

21. The method of claim 20, wherein step (b) comprises coupling a winch to the MWD tool and step (c) comprises extracting the portion of the MWD tool using the winch.

22. The method of claim 21, wherein step (d) comprises detaching the winch and removing the stand-off bracket from the coupling.

23. The method of claim 22, wherein step (d) further comprises unthreading the coupling from the collar.

24. The method of claim 23, wherein unthreading the coupling from the collar further comprises unthreading a crossover sub from the coupling or the collar.

25. The method of claim 20, wherein step (a) comprising threading the coupling of the tool removal system into the collar via a crossover sub.

26. The method of claim 16, wherein a forklift is not required to remove the MWD tool from the collar.

27. A system comprising:

a stand-off bracket;

a winch assembly configured to be mounted to the stand-off bracket, the winch assembly comprising:

a winch;

a power supply for supplying power to the winch; and a controller for operating the winch; and a coupling comprising:

a collar interface configured to be mounted to a collar that contains a measurement while drilling (MWD) tool; and a stand-off bracket interface configured to couple to the stand-off bracket distal from the winch;

wherein the collar interface and the stand-off bracket interface are on opposing sides of the coupling.

28. The system of claim 27, wherein the winch comprises a J-hook configured to couple to the MWD tool inside the collar.

29. The system of claim 27, wherein the stand-off bracket interface is a slot in the coupling.

30. The system of claim 29, wherein the stand-off bracket comprises a rigid tray with a rectangular sectional profile including a base and side walls that are complementary in shape to and can mate with the stand-off bracket interface.

31. The system of claim 27, wherein the collar interface comprises a frustoconical protrusion from the coupling, the frustoconical protrusion being threaded and configured to engage a thread in the collar.

32. The system of claim 27, further comprising a handle removably mounted to the coupling and configured to assist with attaching and removing the coupling relative to the collar.

33. The system of claim 27, wherein the coupling has an aperture through which the MWD tool is removed from the collar.

* * * * *